United States Patent [19]

Kaim et al.

[11] Patent Number: 4,946,052

[45] Date of Patent: Aug. 7, 1990

[54] GRAVITY WEDGE FOR SLACKLESS RAILCAR CONNECTIONS

[75] Inventors: John W. Kaim; Horst T. Kaufhold, both of Chicago, Ill.

[73] Assignee: AMSTED Industries Incorporated, Chicago, Ill.

[21] Appl. No.: 351,066

[22] Filed: May 12, 1989

[51] Int. Cl.[5] ..... B61G 9/20; B61G 9/24; B61G 5/00

[52] U.S. Cl. ..... 213/75 R; 213/62 R; 213/61; 213/69

[58] Field of Search ..... 213/50, 12, 50.5, 70, 213/13, 71, 20, 66, 58, 72, 74, 69, 64, 65, 61, 60, 56, 75 R, 172, 62 R, 62 A

[56] References Cited

U.S. PATENT DOCUMENTS

| | | | |
|---|---|---|---|
| 373,957 | 11/1887 | Young | 213/56 |
| 1,232,594 | 7/1917 | Newell | 213/56 |
| 1,443,716 | 1/1923 | Fletcher | 213/62 R |
| 1,925,319 | 9/1933 | Goodall | 213/62 A |
| 4,456,133 | 7/1984 | Altherr et al. | 213/75 R |

*Primary Examiner*—Andres Kashnikow
*Assistant Examiner*—Mark T. Le
*Attorney, Agent, or Firm*—Charles E. Bouton; Edward J. Brosius

[57] ABSTRACT

A slackless railcar connector system includes a gravity wedge shim that has a tail piece extending from the narrow edge of the sim through an aligning groove in a sill pocket casting, or the like. A biasing member may also be located adjacent the aligning groove to engage the tail piece.

18 Claims, 3 Drawing Sheets

GRAVITY WEDGE FOR SLACKLESS RAILCAR CONNECTIONS

This invention relates to the art of railcar connectors such as couplers, drawbars and the like; and more specifically is directed to an improved wedge component that functions to move so as to fill up space created between other parts due to wear.

BACKGROUND OF THE INVENTION

Connectors for railcars are usually attached to each end of a car underside within the car center sill. A convex end of the connector normally rests against a follower block held within a sill pocket casting that is mounted within the sill to withstand forces tending to thrust the connector into the sill - e.g. compressive or buff loading. Additionally the connector is held against being withdrawn from the sill by a pin or drawbar or by a collar which is spaced from the follower block. When the connector is first assembled to the car the clearances between the aforementioned parts are minimal and there is virtually no slack or movement of the parts longitudinal of the car when the forces on the connector are reversed as occurs each time the car is accelerated or decelerated. However, wear occurs through use causing spaces to be created between the parts. Such spaces are known as slack and the cumulative effect will be to repeat and magnify impact forces upon acceleration and deceleration. One cure for this problem has been to include a wedge shaped shim between two of the parts, usually between the follower block and the closed end of the sill pocket casting as shown in U.S. Pat. Nos. 3,716,146, 4,456,133, 4,549,666 and 4,593,829.

One or both of the adjacent surfaces of the follower block and/or the pocket casting are sloped to correspond to the wedge. The result is that as wear occurs and spaces increase the wedge will move downward by gravity to separate the adjacent parts sufficiently to take up the slack. However, at some point the wear may exceed the ability of the wedge to compensate and it must be replaced or augmented. But heretofore there has been no means to visually gauge the extent of wear and anticipate the need for replacement.

Also there are occasions when connectors must be disassembled from railcars to permit maintenance. At such times the wedge must be separated from the adjacent parts to create sufficient slack to enable the parts to be removed from the sill. But heretofore this has required the insertion of tools through ports in the sill and/or pocket casting to engage and lift the wedge.

Furthermore, as the parts wear, the wedge may rotate or shift within the pocket resulting in poor performance. Moreover in some installations the connector is rotatable within the pocket casting so as to permit a railcar to be rotated for rapid dumping, in which case the parts become inverted and the wedge may unintentionally become dislodged by gravity.

BRIEF SUMMARY OF THE INVENTION

Accordingly, it is a principal object of the present invention to provide a wedge shim for railcar connectors that overcomes one or more of the aforesaid problems.

It is another object of the present invention to provide a rail car connector wedge shim that resists undesired movements between adjacent connector system parts.

It is still another object of the present invention to provide a rail car connector wedge shim that facilitates visual inspection and gauging of wear.

It is yet another object of the present invention to provide a rail car connector wedge shim that will not dislodge when inverted upon relative rotation of the rail car.

It is a further object of the present invention to provide a system of railcar connector parts wherein a wedge shim remains aligned with other adjacent parts.

Briefly stated the present invention involves the inclusion of at least one tail piece or extension projecting from the narrow edge of the wedge and of sufficient length to extend to a point beneath and outside the pocket casting. Preferably a single tail piece projects centrally from the narrow edge of the wedge and extends through a groove in the sill pocket casting.

BRIEF DESCRIPTION OF THE DRAWINGS

Other objects and advantages of the invention will become apparent upon reading the following detailed description in conjunction with the drawings wherein.

DETAILED DESCRIPTION OF THE INVENTION

Figure 1:
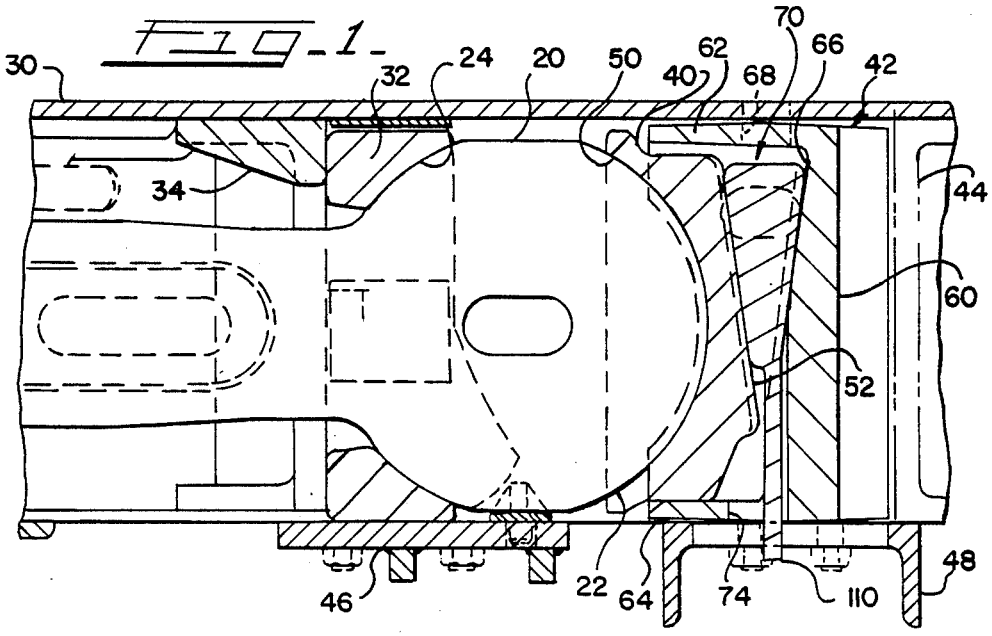
FIG. 1 is a sectional side elevation view of a wedge shim according to the invention installed in a sill pocket casting.

A basic embodiment of the present invention is shown in FIGS. 1–4. In the rail car connector system illustrated in FIG. 1 a rotary drawbar end 20 having spherical butt and shoulder surfaces 22, 24 is held in a rail car center sill 30 by an annular collar bearing 32, which is secured against outward longitudinal movement by stop members 34 secured to the inside surfaces of the center sill, and a follower block 40 located in a sill pocket casting generally 42, which is secured against inward longitudinal movement by draft lugs 44. Cross pieces 46 and 48 are positioned under the sill 30 and fastened by bolts, or the like, to the sill flanges so as to support the collar bearing 32 and pocket casting 42, respectively.

The follower block has a concave forward face 50, generally concentric with and receiving the drawbar butt end surface 22, and a sloped rear face 52. In turn the pocket casting comprises a vertical rear wall 60 and forwardly extending top and bottom walls 62, 64 and side walls (not shown) which peripherally encompass the follower block 40. As illustrated in FIG. 1, the rear wall 60 has an inner sloped surface 66 which is inclined opposite the sloped rear face 52 of the follower block 40 so as to receive a tapered wedge shim generally 70 therebetween. The pocket casting generally 42 normally has upper access ports 68 in the top wall 62 which correspond to openings in the center sill and permit insertion of tools to engage the wedge shim generally 70. Also there is an access slot 74 in the bottom wall 64 of pocket casting 42.

Figure 2:
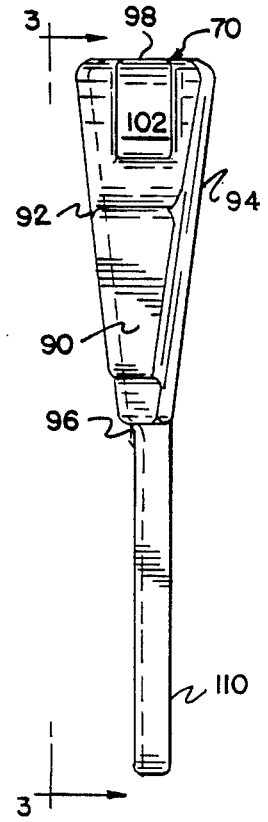
FIG. 2 is a detailed side elevation view of a wedge shim apart from FIG. 1.
Figure 3:
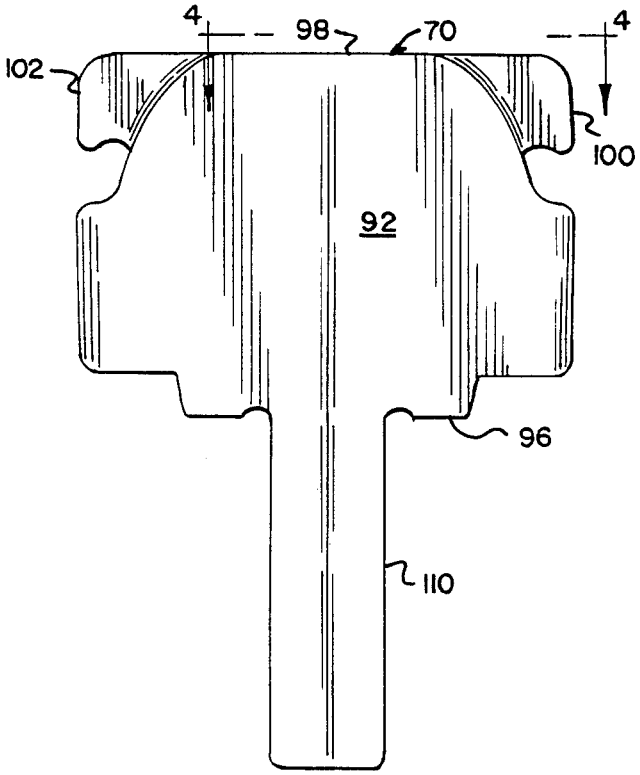
FIG. 3 is an elevation view of the wedge shim of FIG. 2.
Figure 4:
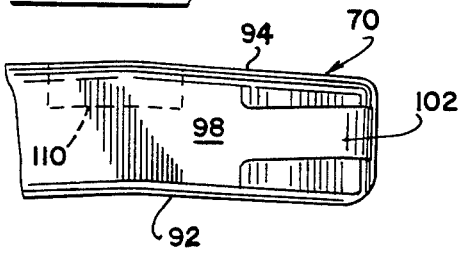
FIG. 4 is a partial top plan view of the wedge shim of FIG. 2.
Figure 5:
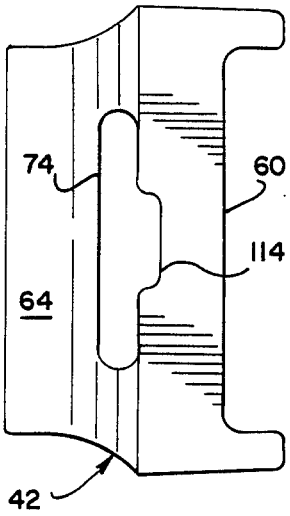
FIG. 5 is a detailed bottom view of a pocket casting apart from FIG. 1.

In the embodiments illustrated the follower block sloped rear face 52 and the pocket casting sloped surface 66 are each comprised of two portions slightly angled at vertical center lines so as to be somewhat convex and concave, respectively. Accordingly, the preferred wedge shim generally 70, as best seen in FIGS. 2–4, comprises a tapered wedge body 90 having front and rear faces 92, 94 diverging from a narrow bottom 96 toward a relatively thick top 98 where two relatively narrow ears 100, 102 project from the sides. As seen in FIG. 4 the wedge faces 92, 94 are chevron like in that each is comprised of angled portions so as to correspond to the convex and concave slopes of the follower block rear face 52 and pocket casting surface 66.

It will be understood that the foregoing word description covers features that are known to the prior art and that the aforementioned ears 100, 102 on wedge 70 permit it to be lifted by tools, inserted through the upper access ports 68, so as to allow sufficient play between the drawbar butt 22 and shoulder 24 portions and the respective annular collar bearing 32 and follower block 40 to enable the parts to be disassembled for repair and the like. Also the chevron-like wedge faces 92, 94 are known in the prior art to promote alignment with the pocket casting rear wall 60 and follower block 40.

The present invention, however, further improves upon those characteristics and additionally provides a visible indicator of the vertical position of the wedge shim generally 70 by including at least one extension means, such as tail piece 110, which extends from the narrow wedge bottom 96 a sufficient length to protrude beneath the pocket casting 42 bottom wall 64. When it becomes necessary to disassemble the parts, the wedge shim 70 may be lifted by simply pushing upwardly on the extension means. Furthermore the extension means is preferably offset on the wedge bottom 96 in the longitudinal direction (to the right as seen in FIGS. 1 and 2) so as to be misaligned with the normal access slot 74 usually found in the pocket casting 42 bottom wall 64. In the preferred form of the present invention an additional alignment means, such as groove 114, is formed with the access slot 74 in pocket casting generally 42 so as to closely receive the wedge extension means. The extension means and alignment means (namely tail piece 110 and groove 114) cooperate to physically retain the wedge shim generally 70 in an upright posture and resist rotational and angled movement of the wedge which otherwise tends to occur when the connector end 20 moves against the follower block 40.

As shown in FIGS. 3 and 4 the preferred extension means is a single tail piece that has a broad cross section transversely centered along the bottom edge 96 of the wedge body and projects parallel to the wedge center line so as to be essentially vertical when positioned between follower block 40 and pocket casting rear wall 60. As seen in the FIGS. 2-4 a horizontal cross section of the tail piece 110 has a major dimension generally aligned with the wedge faces and a minor dimension that intersects and is perpendicular thereto. Furthermore the tail piece 110 is offset longitudinally so as to join the front face 92 of the wedge body 90 and be spaced from the rear face 94. In this way the tail piece 110 will not align with access slot 74 in the sill pocket casting bottom wall 64 and a supplementary groove 114 is formed in the forward side of the slot so as to be aligned with the tail piece 110. The groove 114 is of a transverse dimension to closely receive the tail piece 110 and thereby prevents transverse movement thereof.

It will be understood that the system of follower block, wedge and pocket casting parts may be otherwise designed to offset the wedge extension means in a rearward direction and/or to employ a sloped surface on only one of the follower block and pocket end wall. Similarly such a system of parts employing the present invention may be adapted to a variety of rail car connectors such as couplers and articulated couplings as well as the illustrated drawbar.

Figure 6:
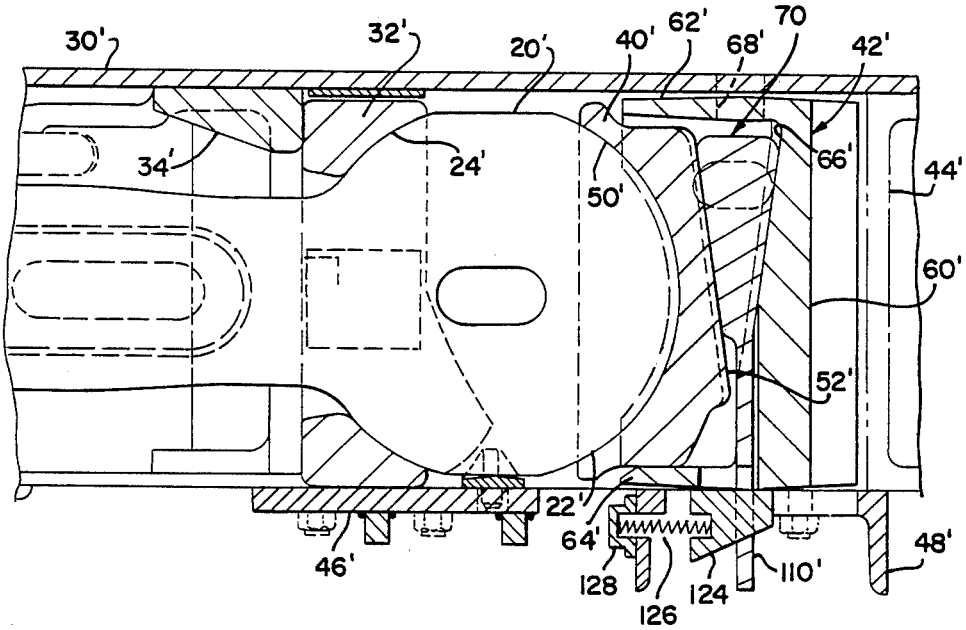
FIG. 6 is a sectional side elevation view of another embodiment of a wedge shim installed in a pocket casting.
Figure 7:
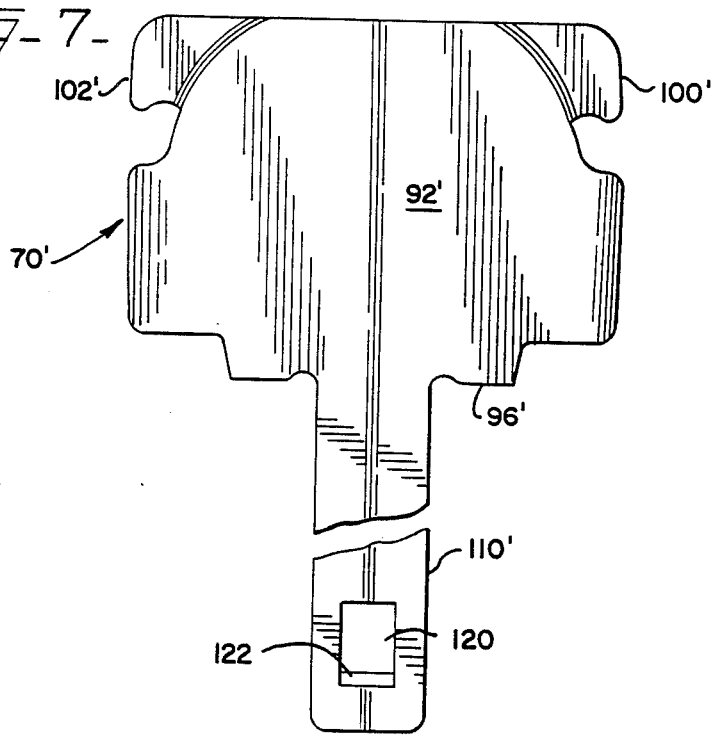
FIG. 7 is an elevation view of the wedge shim apart from FIG. 6.

The invention may also include biasing means to urge the wedge shim in one direction as shown in FIGS. 6 and 7 where parts corresponding to those shown in FIGS. 1–5 are denominated by the same reference numbers bearing a prime notation (′). In this embodiment the lower end of the wedge 70″ tail piece 110′ contains a window 120 with an inclined lower surface 122. Additionally a biasing means comprising a tapered plug 124 is mounted to slide longitudinally across the outside of pocket casting 42′ bottom wall 64′ and is forced toward the window 120 by a spring 126 extending from a seat 128 secured to the cross piece 48′ beneath the pocket casting 42′. When the parts are assembled the tail piece window 120 will extend partially below the pocket casting 42′ and the inclined plug 124 is inserted therethrough so as to bias the tail piece downwardly. This feature tends to prevent lifting of the follower block 40′ as may occur when the connector is angled downwardly. It also will prevent the wedge shim 70′ from becoming dislodged if the rail car is inverted.

Figure 8:
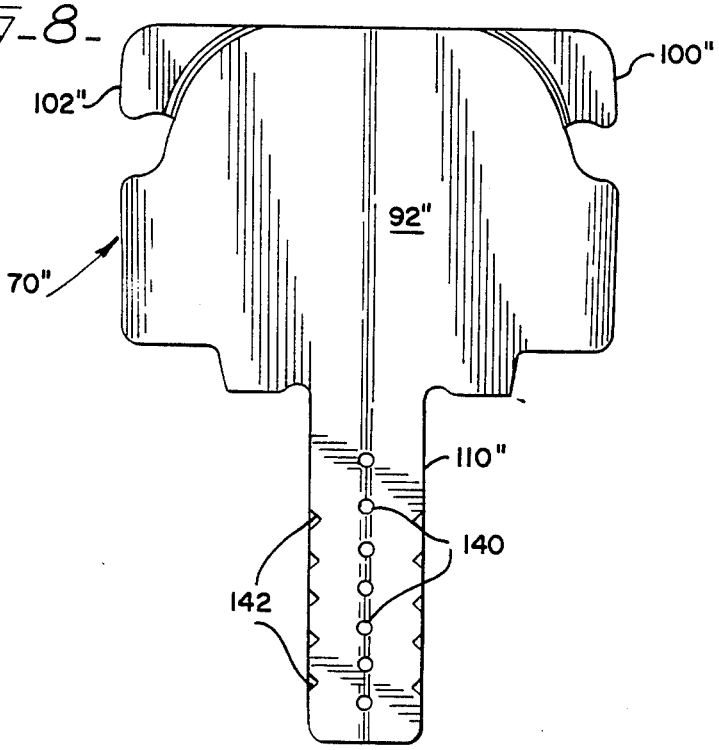
FIG. 8 is an elevation view of still another wedge shim embodiment.

Another wedge shim embodiment is shown in FIG. 8 where elements corresponding to those heretofore described are denominated by the same reference character bearing a double prime notation (″). In this embodiment the wedge shim tail piece 110″ contains a series of vertically spaced apertures 140 and a separate series of notches 142 at the vertical edges thereof. The apertures 140 are useful in combination with a cotter pin, or the like (not shown), which is inserted at the aperture closest to the undersurface of a pocket casting 42. In this way the wedge 70″ will not become dislodged if the car is rotated. From time to time as wear occurs it will become necessary to reposition the pin. Such apertures and the notches 142 also function as a calibration by which the degree of wear, e.g. the distance the wedge shim 70′ descends during service, may be visually determined.

Further modifications and variations may be made in the aforedescribed invention without departing from the spirit and scope thereof which is defined hereafter in the claims.

What is claimed is:

1. An improved gravity wedge shim member for use in combination with slackless railcar connections, said wedge member comprising:

a tapered wedge body having a narrow bottom and relatively thick top; and extension means extending from said narrow bottom, said extension means being offset along said narrow bottom.

2. The wedge shim of claim 1 wherein said extension means comprises a tail piece extending from the central area of said narrow bottom.

3. The wedge shim of claim 2 wherein said tail piece has a broad cross section.

4. The wedge shim of claim 2 wherein said tail piece is offset along said narrow bottom toward a face of said wedge body.

5. The wedge shim of claim 2 wherein said tail piece includes at least one opening therein.

6. The wedge shim of claim 2 wherein said tail piece has a plurality of apertures along the length thereof.

7. An improved gravity wedge shim member for use in combination with slackless railcar connections, said wedge shim member comprising:

a tapered wedge body having a narrow bottom and relatively thick top connected by a front face and a rear face diverging from said bottom; and a single tailpiece extending from the central area of said bottom and offset so as to be spaced form one of said faces.

8. The wedge shim of claim 7 wherein said tail piece has a first cross sectional dimension generally aligned with said faces and a second cross sectional dimension generally intersecting said faces said first dimension being greater than said second dimension.

9. The wedge shim of claim 8 wherein said tail piece includes at least one opening therein.

10. The wedge shim of claim 9 wherein said tail piece opening is a window having an inclined lower surface.

11. The wedge shim of claim 7 wherein said tail piece has a plurality of apertures along the length thereof.

12. The wedge shim of claim 7 wherein said tail piece has plurality of spaced notches along at least a portion of the length thereof.

13. In a system for receiving a railcar connector including a pocket having a rear wall, a follower block adapted to bear against a butt end of a connector, and a gravity wedge shim between said rear wall and said follower block and wherein at least one of said rear wall and follower block has a sloped surface to abut at least one sloped face of the wedge shim, the improvement comprising:

an alignment means comprising a groove in one side of an access slot in the bottom of said pocket; and a single tail piece extending from the center of the lower portion of said wedge into said groove, said tail piece having a dimension that closely fits within said groove.

14. The system of claim 15 wherein said tail piece projects beneath said pocket and contains a window that extends above and below said alignment means, and biasing means cooperatively engaged with said window urging said tail piece and wedge downwardly in said pocket.

15. The system of claim 14 wherein the biasing means is an inclined plug movably mounted beneath said pocket so as to extend into said window and a spring connected to force said inclined plug toward said tail piece.

16. An improved gravity wedge shim for use in combination with slackless railcar connections, said wedge shim comprising:

a tapered wedge body having a narrow bottom and relatively thick top; and a tail piece extending from the central area of said narrow bottom and offset toward a face of said wedge body.

17. An improved gravity wedge shim member for use in combination with slackless railcar connections, said wedge shim member comprising:

a tapered wedge body having a narrow bottom and relatively thick top connected by a front face and a rear face diverging from said bottom; and a single tail piece extending from the central area of said bottom, said tail piece including a window opening having an inclined lower surface.

18. An improved gravity wedge shim member for use in combination with slackless railcar connections, said wedge shim member comprising:

a tapered wedge body having a narrow bottom and relatively thick top connected by a front face and a rear face diverging from said bottom; and a single tail piece extending from the central area of said bottom, said tail piece having a plurality of spaced notches along at least a portion of the length thereof.

* * * * *